US009462915B2

(12) United States Patent
Taingtae et al.

(10) Patent No.: US 9,462,915 B2
(45) Date of Patent: Oct. 11, 2016

(54) SHOWER DOOR CAM SYSTEM

(71) Applicant: Kohler Co., Kohler, WI (US)

(72) Inventors: Weerasak Taingtae, Sheboygan, WI (US); Carl Mueller, Sheboygan, WI (US)

(73) Assignee: KOHLER CO., Kohler, WI (US)

( * ) Notice: Subject to any disclaimer, the term of this patent is extended or adjusted under 35 U.S.C. 154(b) by 279 days.

(21) Appl. No.: 14/208,833

(22) Filed: Mar. 13, 2014

(65) Prior Publication Data

US 2014/0259365 A1 Sep. 18, 2014

Related U.S. Application Data

(60) Provisional application No. 61/793,393, filed on Mar. 15, 2013.

(51) Int. Cl.

| | |
|---|---|
| ***A47K 3/00*** | (2006.01) |
| ***A47K 3/34*** | (2006.01) |
| ***E05D 15/56*** | (2006.01) |

(52) U.S. Cl.

CPC ..... *A47K 3/34* (2013.01); *E05D 15/565* (2013.01); *E05Y 2900/114* (2013.01)

(58) Field of Classification Search

CPC ..... A47K 3/34
USPC ..... 4/596–614
See application file for complete search history.

(56) References Cited

U.S. PATENT DOCUMENTS

| | | | |
|---|---|---|---|
| 433,256 | A | 7/1890 | Phipps |
| 1,045,284 | A | 11/1912 | Haun |
| 1,990,542 | A | 2/1935 | Gilpin |
| 3,276,166 | A | 10/1966 | Markus |
| 4,476,652 | A | 10/1984 | Fermod |
| 4,619,075 | A | 10/1986 | Wiles |
| 4,754,573 | A | 7/1988 | Van Rooij et al. |
| 5,461,829 | A | 10/1995 | Lehto et al. |
| 5,970,657 | A | 10/1999 | Glass |
| 6,497,072 | B2 | 12/2002 | Fries |
| 6,539,669 | B1 | 4/2003 | Heidrich et al. |

FOREIGN PATENT DOCUMENTS

| | | |
|---|---|---|
| CN | 201460606 U | 5/2010 |
| CN | 202596467 U | 12/2012 |
| DE | 102007028473 | 12/2008 |
| JP | 2003343164 | 12/2003 |
| WO | WO2004/022894 | 3/2004 |

OTHER PUBLICATIONS

Chinese Notice of First Office Action regarding Application No. 201410097510.5 (6 pages).
European Search Report dated Jul. 22, 2014 regarding EP Application No. 14160134; 6 pages.

*Primary Examiner* — Lori Baker
(74) *Attorney, Agent, or Firm* — Foley & Lardner LLP

(57) ABSTRACT

A shower door cam system includes at least one shower door having a predetermined number of offset rollers and at least one panel having a predetermined number of offset tracks. Each track is configured to receive one of the rollers. In a closed position of the shower door, the shower door contacts a shower floor of the showering enclosure to form a watertight seal. In an open position of the shower door, the shower door is elevated such that a gap is formed between the shower door and the shower floor of the showering enclosure.

20 Claims, 3 Drawing Sheets

SHOWER DOOR CAM SYSTEM

CROSS REFERENCE TO RELATED APPLICATIONS

This application claims the benefit of U.S. Provisional Application No. 61/793,393 filed on Mar. 15, 2013, which is hereby incorporated by reference in its entirety.

FIELD

The present application relates generally to the field of shower doors. More specifically, the present application relates to a shower door cam system for providing a watertight seal around the shower door without installing a threshold, wall jamb or barrier in a showering enclosure.

BACKGROUND

This section is intended to provide a background or context to the invention recited in the claims. The description herein may include concepts that could be pursued, but are not necessarily ones that have been previously conceived or pursued. Therefore, unless otherwise indicated herein, what is described in this section is not prior art to the description and claims in this application and is not admitted to be prior art by inclusion in this section.

Shower doors must be relatively watertight to prevent water damage and to keep water from spraying or leaking out during a shower. Conventional shower doors may include a watertight seal formed by applying silicone caulk on an inside and an outside of the edges of the shower door. The caulk also serves as a threshold or wall jamb. Some conventional showers further include a barrier projecting from the shower floor along a width of the shower to prevent water from spraying or leaking out during a shower. Thresholds, wall jambs and barriers may not be aesthetically pleasing to a user.

Shower doors are typically set on two tracks installed along a width of the shower openings. A first track may run, for example, along the width of the shower floor. The second track may run, for example, along the top of the shower door's ultimate location. The shower door may be pushed from side to side in the tracks via a roller mechanism. Shower tracks are generally used in assemblies including multiple doors.

SUMMARY

An exemplary embodiment relates to a shower door cam system includes at least one shower door having a predetermined number of offset rollers and at least one panel having a predetermined number of offset tracks. Each track is configured to receive one of the rollers. In a closed position of the shower door, the shower door contacts a shower floor of the showering enclosure to form a watertight seal. In an open position of the shower door, the shower door is elevated such that a gap is formed between the shower door and the shower floor of the showering enclosure Another exemplary embodiment relates to a method of translating a shower door across a width of a showering enclosure. Each of a plurality of offset rollers provided on a shower door is disposed within one of a plurality of offset tracks provided on a panel. The shower door is slid such that the rollers roll along a corresponding track. In a closed position of the shower door, the shower door contacts a shower floor of the showering enclosure to form a watertight seal. In an open position of the shower door, the shower door is elevated such that a gap is formed between the shower door and the shower floor of the showering enclosure.

Additional features, advantages, and embodiments of the present disclosure may be set forth from consideration of the following detailed description, drawings, and claims. Moreover, it is to be understood that both the foregoing summary of the present disclosure and the following detailed description are exemplary and intended to provide further explanation without further limiting the scope of the present disclosure claimed.

BRIEF DESCRIPTION OF THE DRAWINGS

The accompanying drawings, which are included to provide further understanding of the invention, are incorporated in and constitute a part of this specification, illustrate embodiments of the present disclosure and together with the detailed description serve to explain the principles of the present disclosure. No attempt is made to show structural details of the present disclosure in more detail than may be necessary for a fundamental understanding of the present disclosure and the various ways in which it may be practiced.

DETAILED DESCRIPTION

Before turning to the figures, which illustrate the exemplary embodiments in detail, it should be understood that the present disclosure is not limited to the details or methodology set forth in the description or illustrated in the figures. It should also be understood that the terminology is for the purpose of description only and should not be regarded as limiting. An effort has been made to use the same or like reference numbers throughout the drawings to refer to the same or like parts.

Referring generally to FIGS. 1-3D, an exemplary embodiment relates to an improved shower door configured to provide a watertight seal around the shower door without installing a threshold, wall jamb or barrier in a showering enclosure.

Figure 1:
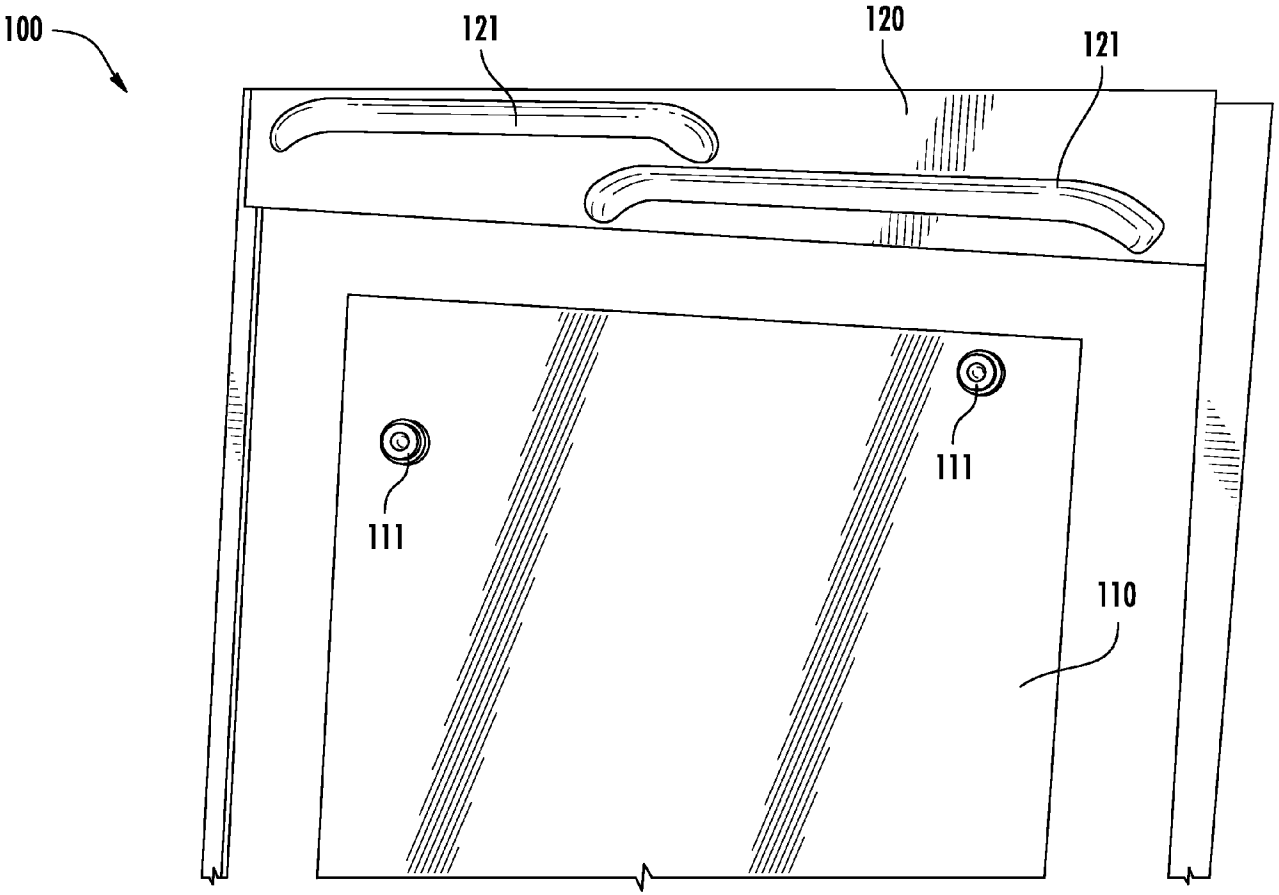
FIG. 1 is a back view of a shower door having two offset rollers and a front view of a panel having two offset tracks configured to receive the two offset rollers of the first shower door panel.
Figure 2:
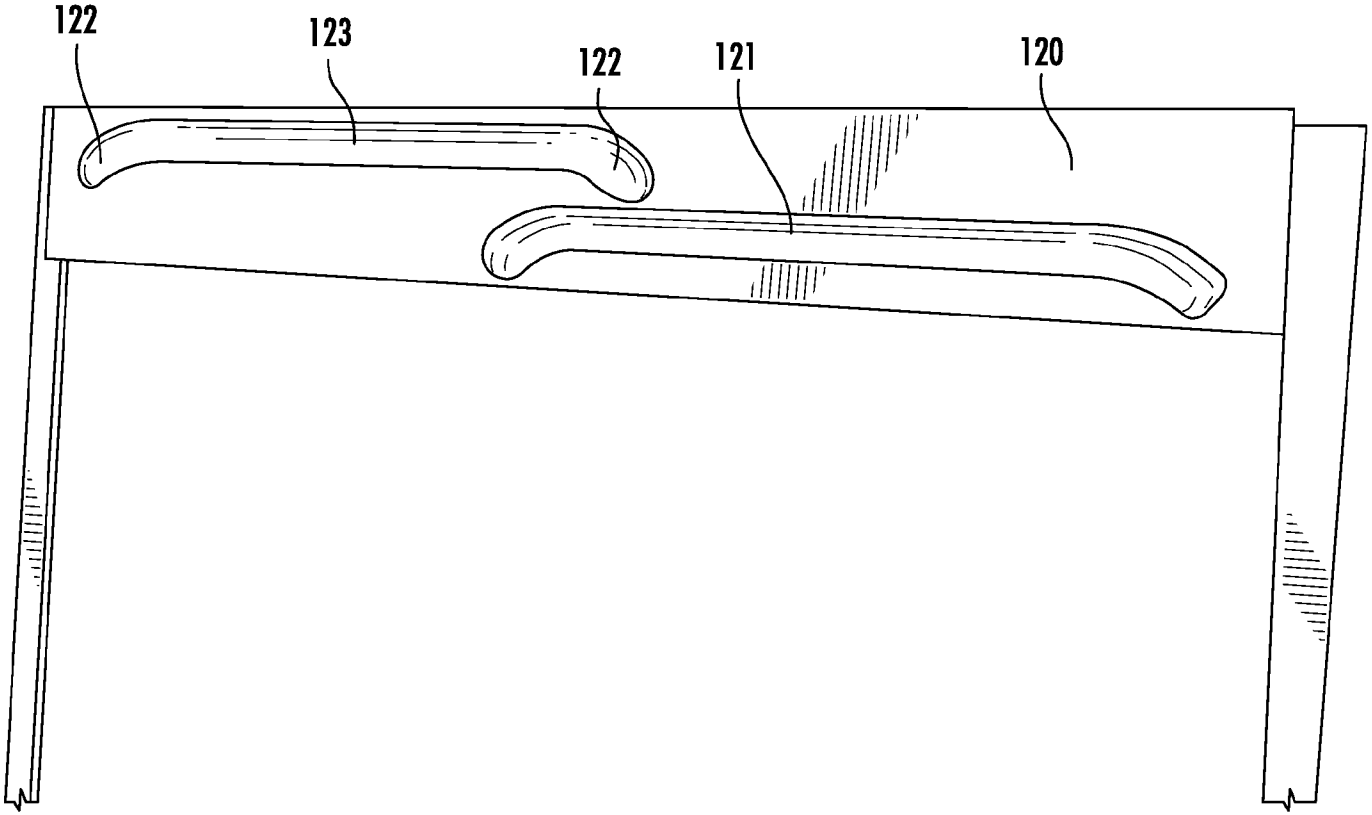
FIG. 2 is a front view of the panel of FIG. 1.

Referring to the figures more particularly, as illustrated in FIGS. 1 and 2, an exemplary embodiment of a shower door cam system 100 includes a shower door 110 having two offset rollers 111 and a panel 120 having two offset tracks 121 configured to receive the offset rollers 111 to assist in a translational motion of the shower door 110. In particular, during translational motion of the shower door 110, the shower door 110 is slid such that each of the offset rollers 111 roll along a corresponding one of the offset tracks 121.

In one embodiment, the two offset rollers 111 are provided at a top portion of a surface of the shower door 110 facing an interior of the showering enclosure.

In an exemplary embodiment, the panel 120 extends along a top of the showering enclosure, across an entire width of the showering enclosure. Each of the two offset tracks 121 includes downward-sloping, curved ends 122 with a straight portion 123 disposed between the ends 122. Each of the two offset tracks 121 is symmetrical with respect to a center of the track 121 and with respect to the other track 121 (i.e., the first offset track 121 has a same size and a same shape as the second offset track 121).

Each of the offset tracks 121 extends approximately half way across a width of the panel 120. In one embodiment, the offset tracks 121 are disposed one above the other such that the offset tracks 121 overlap with respect to a vertical center line of the panel 120. By providing the tracks 121 in an offset and overlapping configuration, as opposed to providing the tracks 121 in a parallel or in a serial configuration, a range of motion of the rollers 111 is increased, while still allowing the shower door 110 to be raised and lowered at the appropriate locations (see FIGS. 3A-3D). A difference in height from a lowest point of the curved end 122 to the straight portion 123 determines a height of a gap 150 (see FIG. 3D) formed between the shower door 110 and a shower floor 130 when the shower door 110 is elevated during its translational motion across a width of the showering enclosure. The translational motion of the shower door 110 will be described in further detail below.

In other embodiments, the track 122 may have a different shape, provided there is a height difference between the lowest point of an end 122 and the straight portion 123. For example, a slope from the end 122 to the straight portion 123 may be more or less steep. In another example, the end 122 may be more or less curved. In yet another example, the end 122 may be linear and provided at a downward slope with respect to the straight portion 123.

In another exemplary embodiment, the shower cam system 100 includes two shower doors 110 (see FIGS. 3A-3D). When two shower doors 110 are provided, each of the two shower doors 110 are configured to separately slide across a width of the showering enclosure. In such a configuration, each shower door 110 includes two offset rollers 111 as illustrated in FIG. 1, and the panel 120 includes two sets of offset tracks 121 (i.e., four tracks 121), each track 121 configured to receive a single roller 111.

Figure 3A:
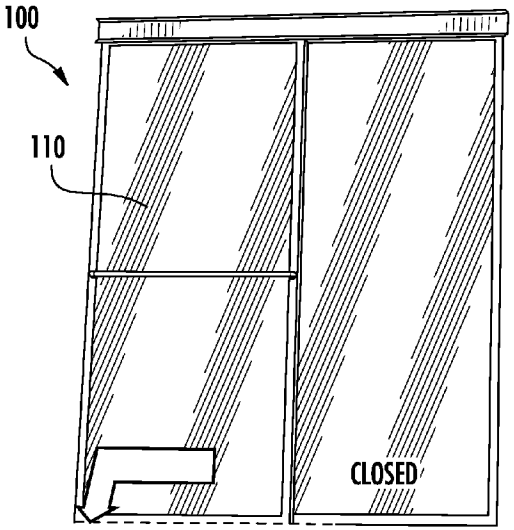
FIG. 3A illustrates a translational motion of the shower door of FIG. 1 along the door panel of FIG. 1 from an open position to a closed position.
Figure 3B:
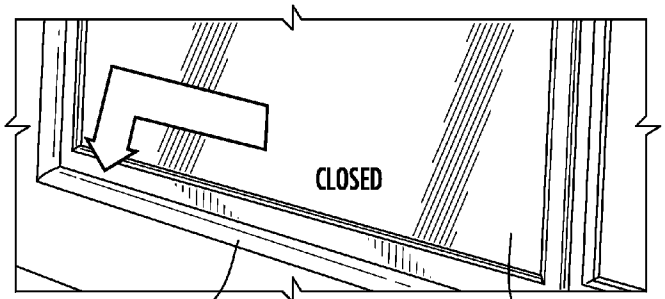
FIG. 3B is a zoomed in view of the shower door of FIG. 3A in the closed position.
Figure 3C:
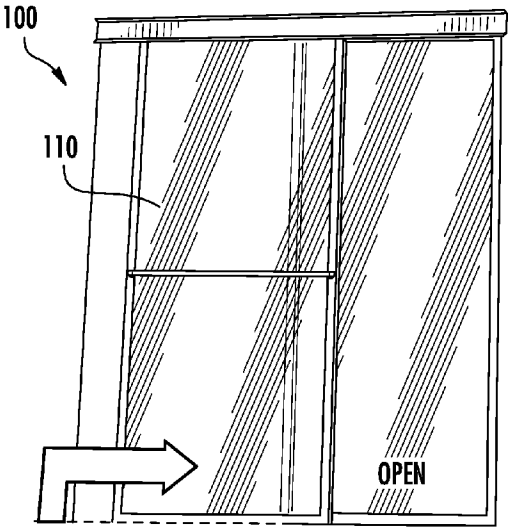
FIG. 3C illustrates a translational motion of the shower door of FIG. 1 along the door panel of FIG. 1 from a closed position to an open position.
Figure 3D:
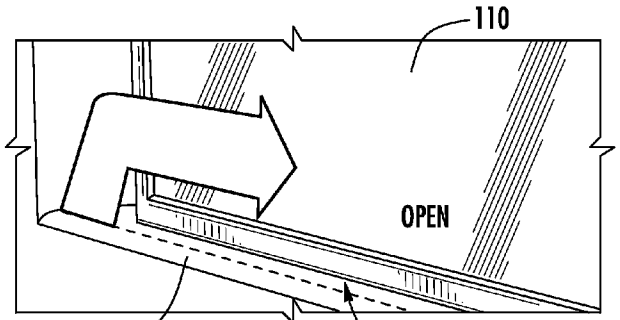
FIG. 3D is a zoomed in view of the shower door of FIG. 3C in the open position.

Referring now to FIGS. 3A and 3B, when the shower door 110 is in a closed position (i.e., when the shower door 110 abuts a wall of the showering enclosure), each of the rollers 111 is located within the curved end 122 of its respective track 121. Referring now to FIGS. 3C and 3D, when the shower door 110 is in an open position, for example, when the shower door 110 is being moved from side to side (i.e., translation motion) across a width of the showering enclosure, each of the rollers 111 is located within the straight portion 123 of its respective track 121. As a result of the configuration of the tracks 121, when the shower door 110 is in the open position, the shower door 110 is elevated off of the shower floor 130 (see arrows in FIGS. 3A-3D indicating translation motion of the shower door 110). When the shower door 110 is in the closed position, the shower door 110 forms a watertight seal along abutting surfaces of the showering enclosure. The watertight seal is configured to contain water within the showering enclosure.

For safety consideration, the height of the gap 150 formed when the shower door 110 is elevated off of the shower floor 130 during the translational motion of the shower door 110 is preferably small enough such that an appendage (e.g., a user's toe) cannot fit between the shower door 110 and the shower floor 130.

Although the shower door 110 and the panel 120 included two offset rollers 111 and two offset tracks 121, respectively, any other number of rollers 111 and tracks 121 may be used, provided the shower cam system 100 is capable of the translational motion described above. A predetermined number of offset rollers 111 used is a same number as a predetermined number of offset tracks 121 used in the shower cam system 100.

According to the embodiments described above, a shower door cam system is provided. The shower door cam system provides a watertight seal around the shower door without installing a threshold, wall jamb or barrier in a showering enclosure.

As utilized herein, the terms "approximately," "about," "substantially", and similar terms are intended to have a broad meaning in harmony with the common and accepted usage by those of ordinary skill in the art to which the subject matter of this disclosure pertains. It should be understood by those of skill in the art who review this disclosure that these terms are intended to allow a description of certain features described and claimed without restricting the scope of these features to the precise numerical ranges provided. Accordingly, these terms should be interpreted as indicating that insubstantial or inconsequential modifications or alterations of the subject matter described and claimed are considered to be within the scope of the invention as recited in the appended claims.

It should be noted that the term "exemplary" as used herein to describe various embodiments is intended to indicate that such embodiments are possible examples, representations, and/or illustrations of possible embodiments (and such term is not intended to connote that such embodiments are necessarily extraordinary or superlative examples).

References herein to the positions of elements (e.g., "top," "bottom," "above," "below," etc.) are merely used to describe the orientation of various elements in the FIGURES. It should be noted that the orientation of various elements may differ according to other exemplary embodiments, and that such variations are intended to be encompassed by the present disclosure.

It is important to note that the construction and arrangement of the shower door cam system as shown and/or described in the various exemplary embodiments is illustrative only. Although only a few embodiments have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter described herein. For example, elements shown as integrally formed may be constructed of multiple parts or elements, the position of elements may be reversed or otherwise varied, and the nature or number of discrete elements or positions may be altered or varied. The order or sequence of any process or method steps may be varied or re-sequenced according to alternative embodiments. Other substitutions, modifications, changes and omissions may also be made in the design, operating conditions and arrangement of the various exemplary embodiments without departing from the scope of the present invention.

What is claimed is:

1. A shower door cam system comprising:

at least one shower door having a predetermined number of offset rollers; and at least one panel having the predetermined number of offset tracks, each track comprising a straight portion disposed between two downward-sloping curved ends, and each track configured to receive one of the rollers, wherein in a closed position of the shower door, the shower door contacts a shower floor of a showering enclosure to form a watertight seal, and wherein in an open position of the shower door, the shower door is elevated such that a gap is formed between the shower door and the shower floor of the showering enclosure.

2. The shower door cam system of claim 1, wherein the offset tracks overlap with respect to a vertical center line of the panel.

3. The shower door cam system of claim 1, wherein in the closed position of the shower door, each roller is located within one of the two downward-sloping curved ends of a corresponding track.

4. The shower door cam system of claim 1, wherein in the open position of the shower door, each roller is located within the straight portion of a corresponding track.

5. The shower door cam system of claim 1, wherein a difference in height from a lowest point of the downward-sloping curved ends to the straight portion determines a height of the gap.

6. The shower door cam system of claim 1, wherein the downward-sloping curved ends are configured to allow the shower door to contact the floor of the showering enclosure when the rollers are located within the downward-sloping curved ends of the track.

7. The shower door cam system of claim 1, wherein the rollers are provided at a top portion of a surface of the shower door configured to face an interior of the showering enclosure.

8. The shower door cam system of claim 1, wherein each of the tracks extends approximately halfway across a width of the panel.

9. The shower door cam system of claim 1, wherein the panel extends across an entire width of the showering enclosure.

10. The shower door cam system of claim 1, wherein each of the tracks is symmetrical with respect to a center of the track.

11. The shower door cam system of claim 1, wherein the shower door cam system comprises two shower doors, each of the shower doors configured to separately slide across a width of the showering enclosure.

12. The shower door cam system of claim 11, wherein each shower door includes the predetermined number of offset rollers and the panel includes two times the predetermined number of offset tracks, each track configured to receive one of the rollers of one of the shower doors.

13. A method of translating a shower door across a width of a showering enclosure, the method comprising:

disposing each of a plurality of offset rollers provided on a shower door within one of a plurality of offset tracks provided on a panel, each track comprising a straight portion disposed between two downward-sloping curved ends; and sliding the shower door such that the rollers roll along a corresponding track, wherein in a closed position of the shower door, the shower door contacts a shower floor of the showering enclosure to form a watertight seal, and wherein in an open position of the shower door, the shower door is elevated such that a gap is formed between the shower door and the shower floor of the showering enclosure.

14. The method of claim 13, wherein the offset tracks overlap with respect to a vertical center line of the panel.

15. The method of claim 13, wherein in the closed position of the shower door, each roller is located within one of the two downward-sloping curved ends of a corresponding track.

16. The method of claim 13, wherein in the open position of the shower door, each roller is located within the straight portion of a corresponding track.

17. The method of claim 13, wherein the downward-sloping curved ends allow the shower door to contact the floor of the showering enclosure when the rollers are located within the downward-sloping curved ends of the track.

18. The method of claim 13, wherein the panel extends across an entire width of the showering enclosure and each of the tracks extends approximately halfway across a width of the panel.

19. The shower door cam system of claim 1, wherein each track has a same shape as another track.

20. The shower door cam system of claim 1, wherein each of the predetermined number of offset rollers are provided on and extend from a surface of the shower door facing an interior of the showering enclosure.

* * * * *